United States Patent [19]

Kolthoff, Jr. et al.

[11] 4,064,934

[45] Dec. 27, 1977

[54] RADIATOR AIR FLOW CONTROL MECHANISM

[75] Inventors: Clyde Paul Kolthoff, Jr., Naperville; Otto J. Brennolt, Woodridge, both of Ill.

[73] Assignee: International Harvester Company, Chicago, Ill.

[21] Appl. No.: 629,932

[22] Filed: Nov. 7, 1975

[51] Int. Cl.[2] ..... F28F 13/02; F28F 13/12; F28F 27/02; F01P 7/00

[52] U.S. Cl. ..... 165/97; 123/41.04; 123/41.18; 123/41.51; 137/601; 165/101

[58] Field of Search ..... 165/97, 98, 101, 103, 165/95, 137; 123/41.04, 41.18, 41.51; 137/601

[56] References Cited

U.S. PATENT DOCUMENTS

| | | | |
|---|---|---|---|
| 2,460,499 | 2/1949 | Grace | 165/95 |
| 2,716,021 | 8/1955 | Evans et al. | 165/97 X |
| 2,919,114 | 12/1959 | Ljungstrom | 165/97 X |
| 3,367,413 | 2/1968 | Forster | 165/101 X |
| 3,370,647 | 2/1968 | Hamm | 165/97 |
| 3,467,176 | 9/1969 | Truhan | 165/97 X |
| 3,627,033 | 12/1971 | Ringquist | 165/103 |
| 3,978,912 | 9/1976 | Penny et al. | 165/97 |

*Primary Examiner*—Charles J. Myhre
*Assistant Examiner*—Sheldon Richter
*Attorney, Agent, or Firm*—John P. O'Brien; Floyd B. Harman

[57] ABSTRACT

An air flow control mechanism for use in a radiator system of the type having a radiator core constructed from a plurality of parallel core sections which are equally spaced apart and aligned in a single row with the opposing faces of adjacent core sections being open to provide air flow passageways through each core sections at right angles to the cooling air directed at the front of the radiator core. The radiator air flow control mechanism comprises gate means operatively connected in each of the spaces between adjacent core sections to pivot between a first and second position, where the gate means in the first position directs the cooling air through each of the core sections' air flow passageways in one direction and where the gate means in the second position reverses the direction of flow through each of these passageways. A drive means is provided for reciprocally moving the gate means between the first and second positions.

6 Claims, 4 Drawing Figures

AIR FLOW
10
12
22
14
16
18
20
26
32
34
36
38
40
42
46
48
50
52
54
56
58
60

RADIATOR AIR FLOW CONTROL MECHANISM

BACKGROUND OF THE INVENTION

This invention relates to an air flow control mechanism, and more particularly, to an air flow control mechanism for radiators.

It has long been known that the heat transfer of cooling air through a radiator core can be controlled by using a plurality of adjustable shutters, such as shown in U.S. Pat. No. 1,329,589 to Fedders. Some of the prior art radiator systems incorporate the adjustable shutters within the radiator core structure, as shown by U.S. Pat. No. 1,352,190 to Hamilton.

The effectiveness of a heat transfer device, such as a radiator, depends on close contact of the flowing fluid with the heat transfer surface. This effectiveness is frequently diminished by the formation of a boundary layer of stagnant air. All of the above mentioned prior art radiator systems have this disadvantage because they have no means to eliminate or diminish the boundary layer by creating turbulence in the air stream passing through the radiator core.

It has been recognized by some sources that reversing the direction of air flow over the cooling surfaces will prevent the formation of a boundary layer to thereby improve their heat transfer effectiveness. One prior art means of accomplishing this was to construct the surface in the form of a cylinder which is rotated so that the air flows radially inward across the surface than radially outward as a second pass. The disadvantage of this system is that is requires extensive changes to the engine compartment, accessories, drives and the like to accommodate the drum and ducting required.

This invention uses the reverse cycling technique for eliminating the boundary layer by a simple modification to existing current cooling systems.

SUMMARY OF THE INVENTION

This invention provides a mechanism for reversing the air flow through the radiator core of a radiator system of the type having a plurality of parallel spaced core sections arranged in a row with the opposing faces of adjacent core sections being open to define an air flow passageway through each core section at right angles to the incoming air flow delivered to the core sections. This invention modifies a conventional radiator core section by providing gate means in each of the spaces between adjacent core sections that is movable between a first and second position, wherein the first direction the gate means directs the cooling air through each of the air flow passageways in one direction and in the second gate position reverses the direction of air flow through each of these passageways. A drive means is provided for reciprocally moving the gate means between the first and second positions to thereby create a turbulence in the air stream that will prevent the boundary layer of stagnant fluid from being formed along the heat transfer surfaces.

BRIEF DESCRIPTION OF DRAWINGS

For a better understanding of this invention, reference may be made to the accompanying drawings in which.

DESCRIPTION OF PREFERRED EMBODIMENT

Figures 1, 2:
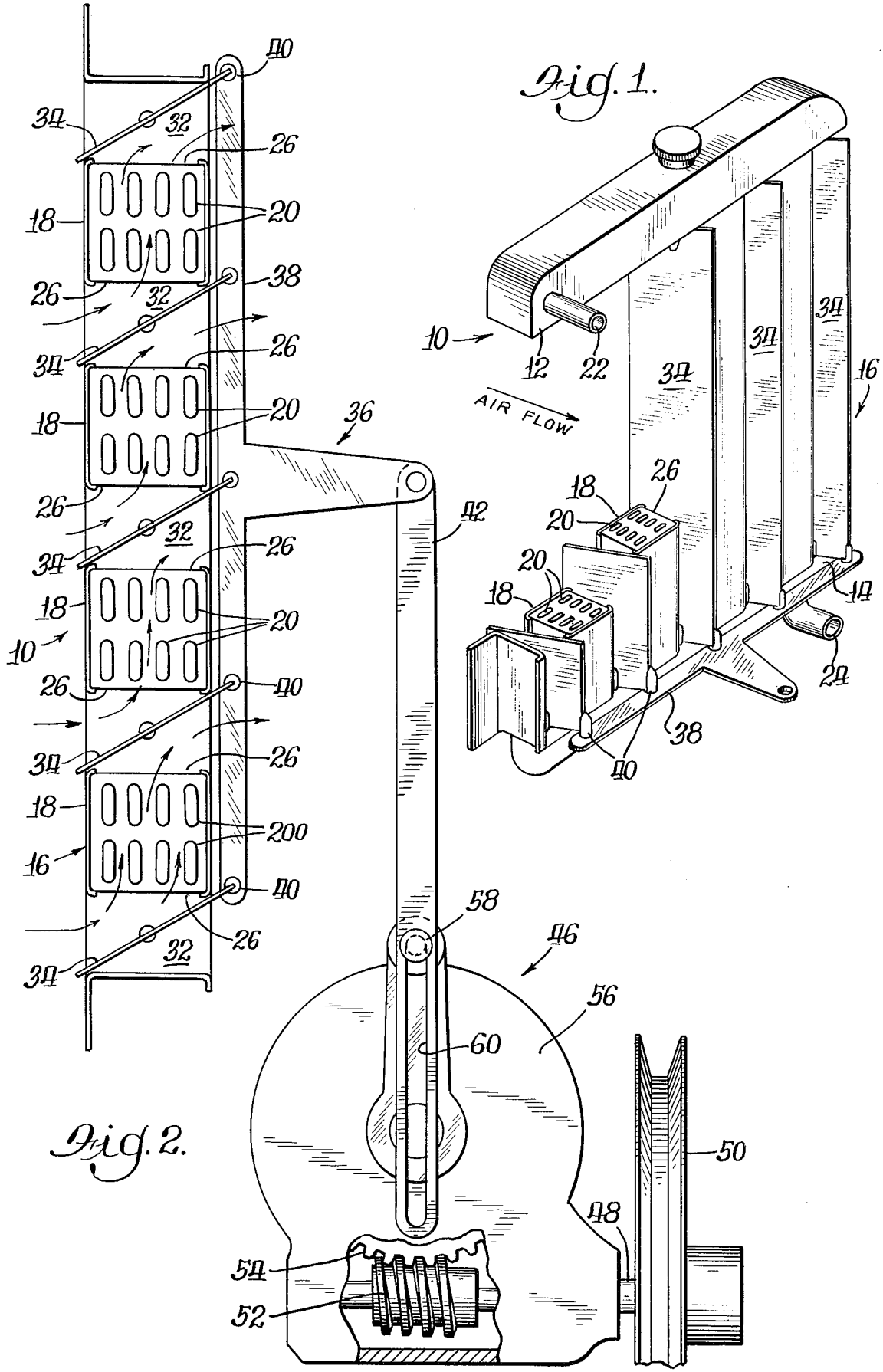
FIG. 1 is a rear prospective view of a radiator embodying the principles of this invention.
FIG. 2 is a vertical sectional view of the radiator of FIG. 1 and the associated drive mechanism for the air flow control mechanism.

Referring to FIG. 1 there is shown a radiator generally designated by the reference numeral 10 and of the type that is normally used to cool an internal combustion engine. Radiator 10 is constructed of an upper header 12 and a lower header 14 which are interconnected by a radiator core 16. Radiator core 16 consists of a plurality of parallel spaced core sections 18 (four shown in the drawing). Each of the core sections 18 are of conventional design in which a plurality of water tubes 20 are held in a spaced parallel relationship by cooling fins (not shown).

As is conventional, the upper header 12 is formed within inlet opening for receiving the end of flexible tubing 22 which returns the water from the engine. Likewise, the lower header 14 is provided with an outlet opening for receiving flexible tubing 24 to return the cooled water to the engine. In conventional water cooling systems of the type shown in FIG. 1 the heated water entering upper header 12 passes down through the rows of water tubes 20 of each core section 18 and their associated fins structure conducts the heat away from the water passing through the water tubes to cool the liquid.

To provide further cooling most water cooled systems include a fan (not shown) placed directly in front of the radiator core that passes air across the fins to accelerate the heat transfer away from the row of water tubes 20. An air flow passageway through each of the core sections 18 is designed at right angles to the front of the radiator 10 by constructing each core sections 18 to have open faces 26 for both of its lateral sides which face the opposing core section.

Figure 3:
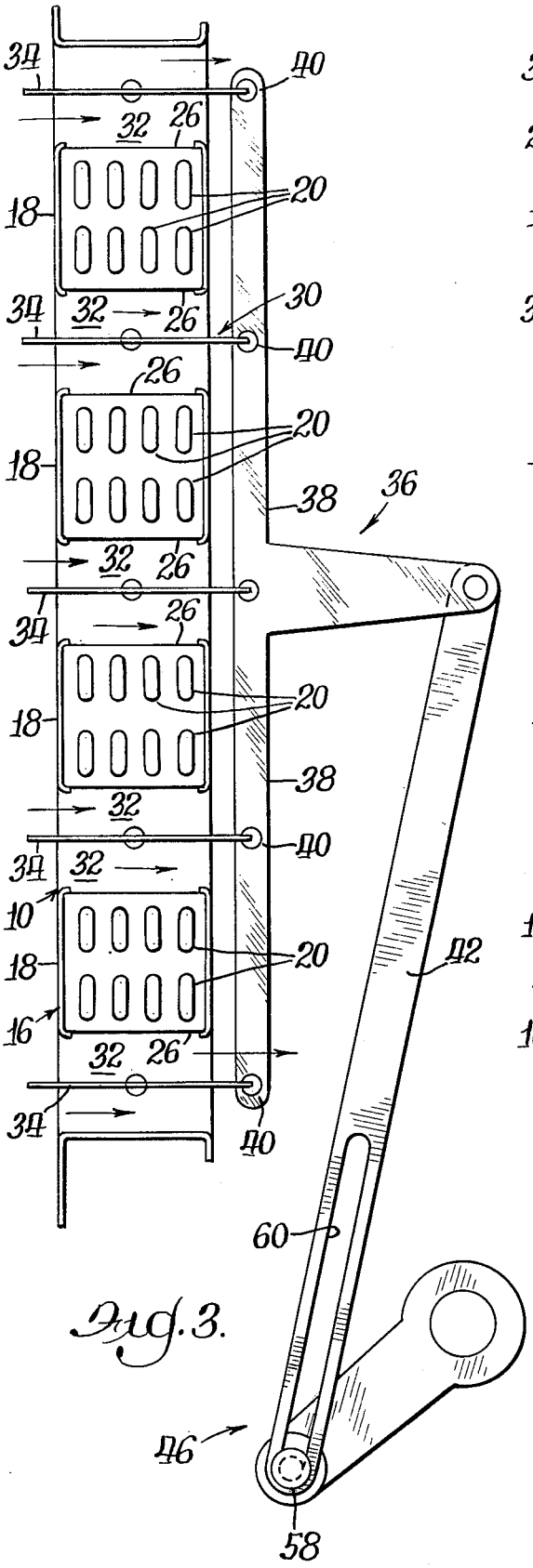
FIGS. 3 and 4 are identical to FIG. 2 with the exception that FIG. 3 shows the relative position of parts of the air flow control mechanism in the neutral position and FIG. 4 shows the relative position of parts of the air flow control mechanism in a second gate position.
Figure 4:
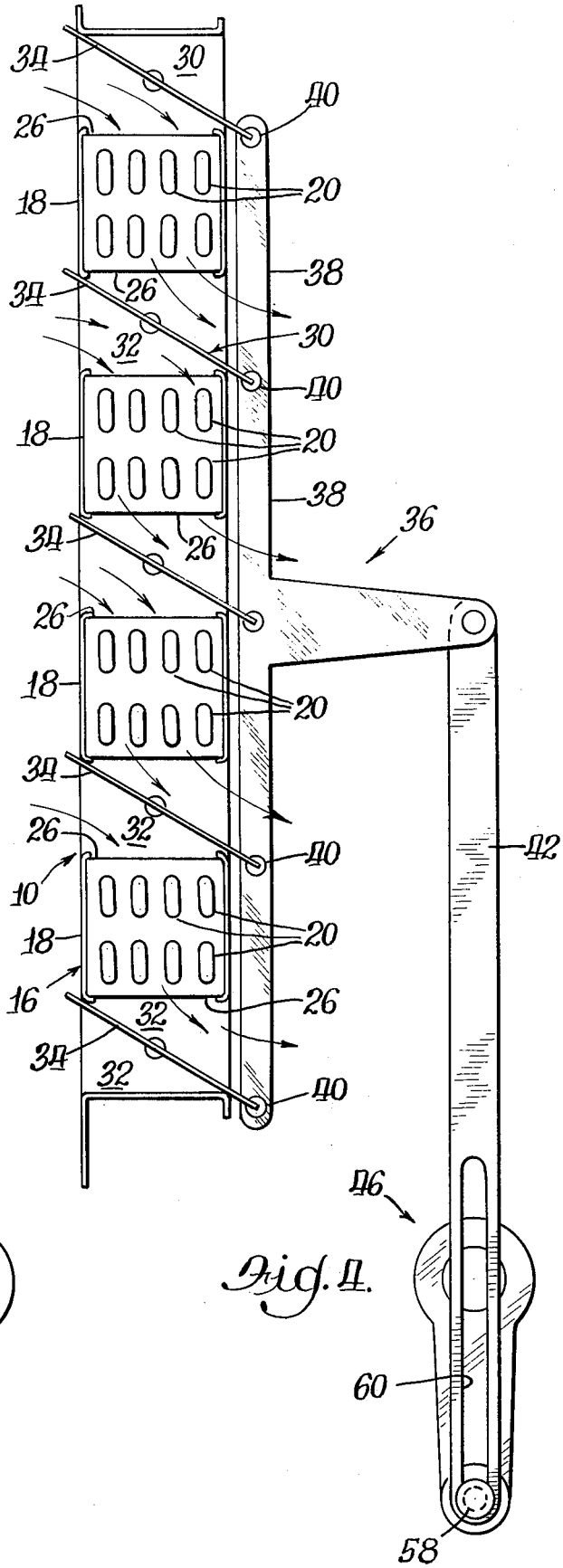

To laterally direct the cooling air through each core section 18, a gate means 30 is provided in each of the spaces 32 between adjacent core sections 18 of the radiator core 16. Gate means 30 is depicted in the drawings as an elongated rectangular shaped baffle plate 34 pivotally mounted along the intersection line of the two diagonal planes of the tetrahedral space 32. As depicted in FIGS. 2 through 4, each baffle plate 34 can be swung between a first position (FIG. 2) in which the incoming air flow passes in one direction through the core sections 18 and a second position (FIG. 4) in which the incoming air flow passes in a reverse direction through each core section 18.

To provide the constant reversing of the direction of air flow over the cooling surfaces of each core section 18, there is provided a drive means 36 which reciprocably moves the baffle plates 34 in unison between the first (FIG. 2) and second (FIG. 4) positions. Drive means 36 is illustrated in FIGS. 2–4 as comprising a linkage member 38 extending across the rear of the radiator 10 and pivotally connected at 40 to the rearward lateral side of each baffle plate 34. A connecting rod 42 interconnects the linkage member 38 and the drive gear assembly 46.

The eccentric drive assembly 46 consists of a drive shaft 48 driven by pulley 50 for rotation of worm gear 52 which intermeshes with gear 54 on eccentric disc 56.

Rotation of eccentric disc 56 causes the roller 58 located on its outer peripheral edge to turn in a circular path and the movement of roller 58 within the elongated slot 60 of the inner end of connecting rod 42 reciprocably drives linkage member 38 between the position of FIG. 2 and the position of FIG. 4.

The particular eccentric drive assembly 46 disclosed above forms no part of this invention and it will be appreciated that many other drive arrangements can be used for reciprocably driving the baffle plates 34 between the first and second positions. Such alternative drive arrangements would include cams and push rods, over-centered trip linkages, Geneva drives.

Likewise it will appreciated that other gate means 30 might be used in place of the baffle plates 34 depicted in the drawings. For example, gate means 30 could be constructed of constantly rotating gates with seals which would operate in a manner resemblying revolving doors. Another possible gate means would be the use of reciprocating perforated plates.

From the above description and the illustration of this invention in FIGS. 2 through 4, it is believed that the operation of this invention is readily understandable. When the eccentric drive assembly 46 moves the baffle plates 34 in unison to the first position illustrated in FIG. 2, the baffle plates 34 direct the incoming air flow to the left (as viewed from the front end of radiator 10) through the air flow passageway between open faces 26 of each of the core sections 18. When the roller 58 turns through a 180° arc from the position shown in FIG. 2, the baffle plates 34 are swung to the diagonally opposite corners formed by the guadrahedral space 32 to direct the air in the reversed direction (toward the right as viewed from the front of the radiator 10). Between the first and second positions, the baffle plates 34 will permit the air flow to completely bypass the radiator core sections 18. However, by bypassing through this condition rapidly, a brief pulse of high velocity air is created which when the gate is shut, the ram pressure created by decelerating the air is available to initiate flow to the core sections 18.

What is claimed is:

1. An improvement in a radiator system of the type having a radiator core comprising a plurality of parallel spaced core sections arranged in a row with the opposing faces of adjacent core sections being open to define an air flow passageway through each core section at a constant transverse angle to the direction that the cooling air is delivered towards said row of core sections, said improvement comprising gate means having a first position for directing the cooling air through each of said air flow pageways of said core sections in one direction and having a second position for directing the cooling air through each of said air flow passageways in the opposite direction to said one direction, and drive means for continuously reciprocating said gate means between said first and second positions.

2. The improvement as defined in claim 1, wherein said gate means comprises a baffle plate pivotally supported between each of said adjacent core sections on an axis parrallel to said opposing faces of adjacent core sections, the width of each of said baffle plates being of sufficient length to engage the diagonally opposite corners of said opposing longitudinal faces of said adjacent core sections.

3. The improvement as defined in claim 2, wherein said drive means comprises a drive member extending across said row of core sections and in driving engagement with each of said baffle plates in a manner to reciprocally rotate said baffle plates in unison from one pair of diagonally opposite corners of said opposing faces of said adjacent core sections to the other pair of diagonally opposite corners.

4. An improvement in a radiator system of the type having a radiator core comprising a plurality of parallel equally-spaced core sections aligned in a single row with the opposing faces of adjacent core sections being open to define an air flow passageway through each core section at a constant right angle to the direction that air is delivered into the space between said adjacent core sections, said improvement comprising gate means operatively connected in each space between said adjacent core sections having a first position for directing the cooling air through each of said air flow passageways of said core sections in one direction and having a second position for directing the cooling air through each of said air flow passageways in the reverse direction to said one direction, and drive means for continuously reciprocating said gate means between said first and second positions.

5. The improvement as defined in claim 4, wherein said gate means comprises a baffle plate pivotally supported at the center of said space between each of said adjacent core sections on an axis parallel to said opposing faces of adjacent core sections, the width of each of said baffle plates being of sufficient length to engage the diagonally opposite corners of said opposing faces of said adjacent core sections.

6. The improvement as defined in claim 5, wherein said drive means includes a drive member extending across said single row of core sections and in driving engagement with each of said baffle plates in a manner to reciprocally rotate all of said baffle plates in unison from one pair of diagonally opposite corners of said opposing faces of said adjacent core sections to the other pair of diagonally opposite corners.

* * * * *